US006712196B2

(12) United States Patent
Ikemoto et al.

(10) Patent No.: US 6,712,196 B2
(45) Date of Patent: Mar. 30, 2004

(54) EMPTY BAG SUPPLYING APPARATUS AND A PRODUCT-FILLED BAG EXTRACTION APPARATUS IN A CONTINUOUS CONVEYING TYPE BAG-FILLING PACKAGING MACHINE

(75) Inventors: Iwao Ikemoto, Iwakuni (JP); Shoichi Koga, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 87 days.

(21) Appl. No.: 10/120,759

(22) Filed: Apr. 11, 2002

(65) Prior Publication Data

US 2002/0148206 A1 Oct. 17, 2002

(30) Foreign Application Priority Data

Apr. 13, 2001 (JP) ..... 2001-116217

(51) Int. Cl.[7] ..... B65G 47/34
(52) U.S. Cl. ..... 198/468.2; 198/430; 198/433
(58) Field of Search ..... 198/409, 430, 198/433, 468.2; 271/3.24, 85, 268

(56) References Cited

U.S. PATENT DOCUMENTS 3,659,693 A * 5/1972 Muller ..... 198/468.2
3,855,907 A 12/1974 Johnson et al.
4,084,684 A * 4/1978 Skinner, II ..... 198/468.2
4,274,792 A * 6/1981 Roth et al. ..... 198/468.2
4,739,874 A * 4/1988 Akutagawa et al. ..... 198/468.2

FOREIGN PATENT DOCUMENTS

| | | |
|---|---|---|
| DE | 36 39 494 | 5/1988 |
| EP | 0 860 362 | 8/1998 |
| GB | 915 846 | 1/1963 |
| GB | 934 268 | 8/1963 |
| JP | 59-221201 | 12/1984 |
| JP | 3-12645 | 2/1991 |
| JP | 06-199317 | 7/1994 |
| JP | 08-301232 | 11/1996 |

* cited by examiner

*Primary Examiner*—Joseph E. Valenza
(74) *Attorney, Agent, or Firm*—Koda & Androlia

(57) ABSTRACT

An empty bag supplying apparatus used in a continuous conveying type bag-filling packaging machine in which the empty bag supplying apparatus receives empty bags and transfers these empty bags to gripper pairs of the bag-filling packaging machine that are moved continuously at a constant speed. The empty bag supplying apparatus includes downward-facing bag holding members and a reciprocating movement mechanism. The bag holding members hold the upper portions of bags. The reciprocating movement mechanism causes the bag holding members to reciprocate along an arc-shaped path and keeps the empty bags held by the holding members to be parallel to the direction of movement of the gripper pairs during the reciprocating motion. In a bag transfer region established in the arc-shaped path path, the speed of the bag holding members holding the empty bags is equal to the moving speed of the gripper pairs.

6 Claims, 8 Drawing Sheets

EMPTY BAG SUPPLYING APPARATUS AND A PRODUCT-FILLED BAG EXTRACTION APPARATUS IN A CONTINUOUS CONVEYING TYPE BAG-FILLING PACKAGING MACHINE

BACKGROUND OF THE INVENTION

1. Field of the Invention

The present invention relates to a continuous conveying type bag-filling packaging machine and more particularly to an empty bag supplying apparatus and a product-filled bag extraction apparatus that are used in the continuous conveying type bag-filling packaging machine.

2. Prior Art

In a continuous conveying type bag-filling packaging machine, empty bags are supplied to gripper pairs that move continuously along a loop-form endless path, both side edges of bags are gripped by the gripping sections of gripper pairs so that the bags are suspended, and various packaging treatments such as opening of the bag mouths, filling of the bags with contents and sealing of the bag mouths, etc. are performed on these bags.

In such a continuous conveying type bag-filling packaging machine, an empty bag supplying apparatus and a product-filled bag extraction apparatus are employed. The empty bag supplying apparatus supplies empty bags to gripper pairs, and the product-filled bag extraction apparatus receives product-filled bags and then discharges the product-filled bags to the outside of the movement path.

The empty bag supplying apparatus used in the continuous conveying type bag-filling packaging machine must cause the bags to move in conformity with the gripper pairs of the bag-filling packaging machine, and it also must transfer the empty bags to the gripper pairs during this movement.

Various proposals have been made concerning such empty bag supplying apparatuses. However, conventional empty bag supplying apparatuses of this type involve respective problems:

(1) Endless belt type empty bag supplying apparatus (Japanese Patent Application Laid-Open (Kokai) No. 59-221201)

In this apparatus, a ventilated endless belt that is mounted between two drums is used. The empty bags are caused to adhere to the surface of the belt by vacuum suction and supported by supporting claws, and then, the empty bags are caused to move in conformity with the gripper pairs. Since this apparatus is large, a large installation space is required for the packaging machine as a whole. Furthermore, since the structure of the apparatus is complicated, the apparatus is expensive and has poor cleaning and maintenance characteristics.

(2) Rotary type empty bag supplying apparatus (Japanese Patent Application Laid-Open (Kokai) No. 6-199317, Japanese Patent Application Laid-Open (Kokai) No. 8-301232)

In these prior arts, empty bags are suction-chucked by suction disks attached to the circumference of a rotating member at equal intervals, so that the empty bags are caused to move in conformity with the gripper pairs. However, the structures of these prior art apparatuses are extremely complicated, and they are expensive and have poor cleaning and maintenance characteristics.

(3) Reciprocating pivoting type empty bag supplying apparatus (Japanese Utility Model Application Publication (Kokoku) No. 3-12645)

In this bag supplying apparatus, the upper edges of empty bags are held by opening and closing holding plates that are disposed on the circumference of a tracking table. This tracking table makes a back and forth rotating motion. The holding plates are caused to move in conformity with the gripper pairs and returned to their original positions after the transfer of the empty bags. In this apparatus, the tracking mechanism is complicated. Thus, the apparatus is expensive and has poor cleaning and maintenance characteristics.

Meanwhile, as to the product-filled bag extraction apparatus, when the product-filled bags are removed from a continuous conveying type bag-filling packaging machine, the gripping sections of the gripper pairs are opened so that the product-filled bags are dropped onto a conveying means such as a conveyor belt, etc., either directly or via a chute, etc., and then the product-filled bags are conveyed out to an after-process. In such an apparatus, however, it is difficult to drop the product-filled bags into fixed positions on the conveying means in a secure and stable manner.

SUMMARY OF THE INVENTION

The present invention was made in light of the above-described problems relating to such empty bag supplying apparatuses and product-filled bag extraction apparatus used in continuous conveying type bag-filling packaging machines.

It is an object of the present invention to provide an empty bag supplying apparatus and a product-filled bag extraction apparatus which are simple in structure, thus reducing the costs and providing superior advantages in terms of cleaning and maintenance characteristics.

The above object is accomplished by a unique structure for an empty bag supplying apparatus used in a continuous conveying type bag-filling packaging machine.

More specifically, the empty bag supplying apparatus receives empty bags that are positioned in a vertical attitude with mouths of the bags facing upward and transfers the bags to respective gripper pairs of the bag-filling packaging machine, the gripper pairs being moved continuously at a constant speed and at a uniform spacing and gripping both side edges of the bags by means of its gripping sections and conveying the bags in a vertically suspended fashion, wherein the empty bag supplying apparatus is comprised of:

- downward-facing bag holding members which open and close at a specified timing so as to hold upper portions of the bags when closed,
- a reciprocating movement mechanism which causes the bag holding members to perform a reciprocating motion along an arc-shaped path on a horizontal plane and which causes the bags held by the bag holding members to be set substantially parallel to a direction of movement of the gripper pairs at all times, and
- a bag transfer region that is established at an intermediate point on the arc-shaped path, the arc-shaped path substantially overlapping a movement path of the gripping sections of the gripper pairs within the bag transfer region, and a speed of the reciprocating motion of the bag holding members in a direction of movement of the gripper pairs being set to be substantially equal to a moving speed of the gripper pairs at least within the bag transfer region.

In the above structure, the "bag transfer region" refers to a region in which both side edges of the empty bags held by the bag holding members are gripped by the gripper pairs, and the bag holding members are opened so that the empty bags are released, so that the empty bags are transferred from the bag holding members to the gripper pairs.

In the present invention, when the bag holding members are moved in the direction of movement of the gripper pairs, this is referred to as an advancing motion; and when the bag holding members are moved in the opposite direction, this is referred to as a returning motion.

The above object is further accomplished by a unique structure for a product-filled bag extraction apparatus used in a continuous conveying type bag-filling packaging machine.

More specifically, the product-filled bag extraction apparatus receives product-filled bags, upon which packaging treatment has been completed, from respective gripper pairs of the bag-filling packaging machine and then discharges the product-filled bags to an outside of the movement path of the gripper pairs, the gripper pairs being moved continuously at a constant speed and at a uniform spacing and gripping both side edges of the bags by means of its gripping sections and conveying the bags in a vertically suspended fashion wherein:

the product-filled bag extraction apparatus is comprised of:

downward-facing bag holding members which open and close at a specified timing so as to hold upper portions of the bags when closed, a reciprocating movement mechanism which causes the bag holding members to perform a reciprocating motion along an arc-shaped path on a horizontal plane and which causes the bags held by the bag holding members to be set substantially parallel to a direction of movement of the gripper pairs at all times, and a bag receiving region that is established at an intermediate point on the arc-shaped path, the arc-shaped path substantially overlapping a movement path of the gripping sections of the gripper pairs within the bag receiving region, and a speed of the reciprocating motion of the bag holding members in a direction of movement of the gripper pairs being set to be substantially equal to a moving speed of the gripper pairs at least within the bag receiving region.

In the above structure, the "bag receiving region" refers to a region in which the upper portions of the product-filled bags whose side edges are gripped by the gripper pairs are held by the bag holding members, and the gripper pairs are opened so that the product-filled bags are released, thus causing the product-filled bags to be received by the bag holding members from the gripper pairs.

Preferably, in the above empty bag supplying apparatus and in the above product-filled bag extraction apparatus, a plurality of the bag holding members are attached to a common supporting member that performs a reciprocating motion along an arc-shaped path and also performs a translational motion during this reciprocating motion. Furthermore, the bag holding members are preferably disposed along the direction of movement at the same spacing as the gripper pairs.

Furthermore, the mechanism that causes the supporting member to perform the reciprocating motion comprises: two pivoting shafts disposed with a specified distance in between, and respective swing shafts which are always positioned at equal distances and in the same direction with respect to the respective pivoting shafts, the swing shafts swinging about the respective pivoting shafts as the pivoting shafts rotate; and the supporting member performs the translational motion as a result of being connected to the swing shafts.

The supporting member that performs a translational motion always faces in the same direction. As a result, the bag holding members also always face in the same direction (with the holding surfaces parallel to the direction of movement of the gripper pairs) during the reciprocating motion.

The empty bag supplying apparatus and the product-filled bag extraction apparatus of the present invention are used mainly in cases where the endless path of the continuously moving gripper pairs is set on a horizontal plane. However, they can be used in cases where the endless path is set vertically.

Furthermore, the empty bag supplying apparatus and the product-filled bag extraction apparatus are used mainly for rectilinear regions of the endless path of the gripper pairs. However, if the curvature is relatively small, in other words, when the gripper pairs are installed on the circumference of a relatively large-diameter rotating table and rotate continuously, then the empty bag supplying apparatus and the product-filled bag extraction apparatus can be used in regions in which the gripper pairs are moved along a curved endless path. In this case, the arc-shaped path of the bag holding members can be set with the tangential direction of the endless path of the gripper pairs in the bag transfer region and in the bag receiving region of the arc-shaped path viewed as the direction of movement of the gripper pairs.

DETAILED DESCRIPTION OF THE INVENTION

The empty bag supplying apparatus and product-filled bag extraction apparatus of the present invention will be described below with reference to FIGS. 1 through 8.

Figure 1:
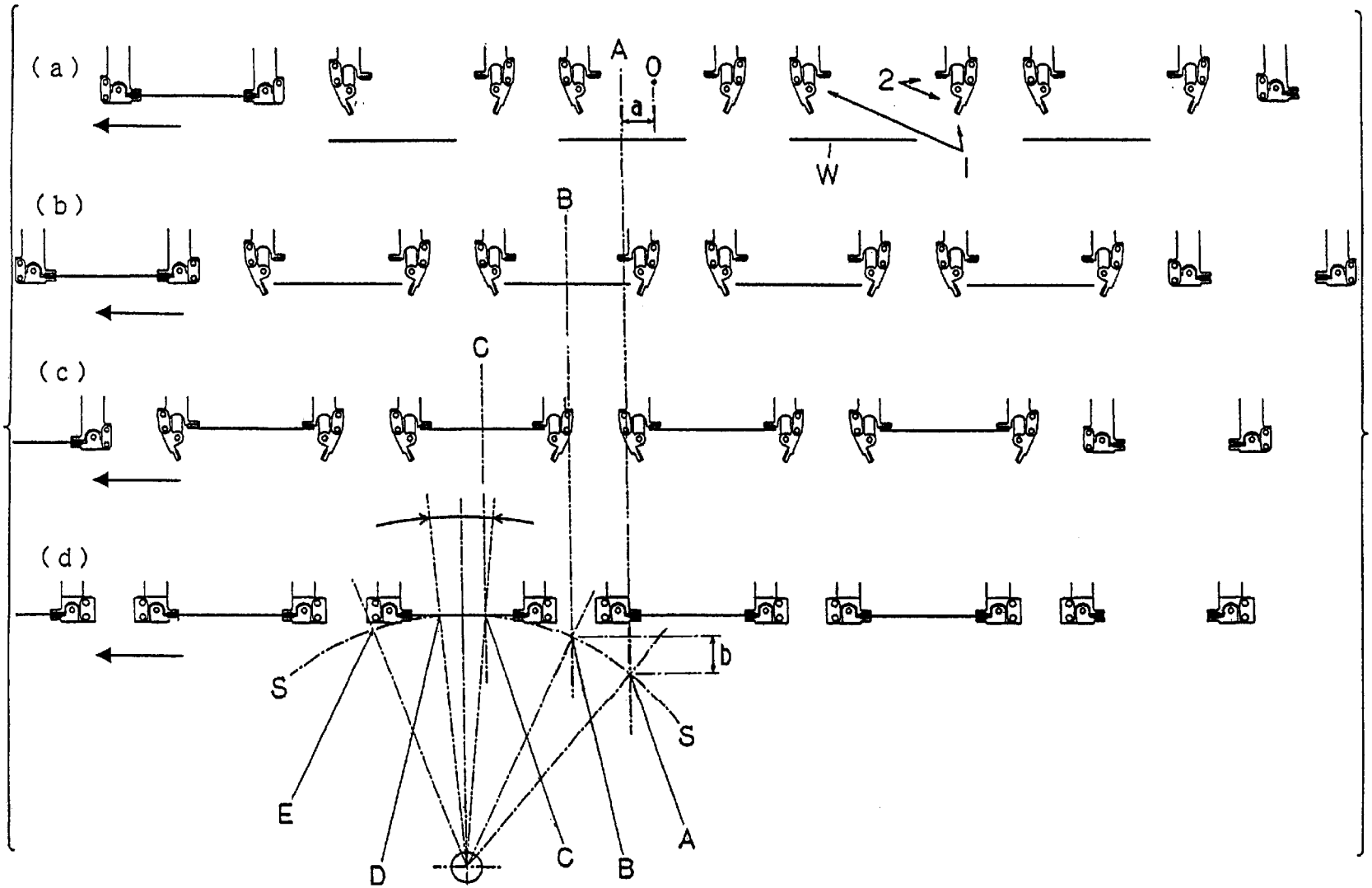
FIGS. 1A, 1B, 1C and 1D are schematic diagrams showing the operation of the empty bag supplying apparatus of the present invention.

FIG. 1 shows (in model form as a time series) a process in which empty bags W are supplied (with four bags being supplied at a time) in a rectilinear region of a loop-form endless path set on a horizontal plane to respective gripper pairs 1 which are moved continuously (the moving direction being shown by arrow in each of (a) through (d) of FIG. 1) at a constant speed along the endless path.

Bag holding members (described later) perform a reciprocating motion on the horizontal plane along an arc-shaped path S (FIG. 1 showing one of arc-shaped paths S of four bag holding members) between a reciprocating-motion starting position A and a reciprocating-motion end position E, and empty bags W with upper edges thereof being held by the bag holding members make an advancing motion (A→C-D) on the horizontal plane along the arc-shaped path S. During this motion, the empty bags W are set parallel to the direction of movement of the gripper pairs 1 at all times (thus making a translational motion).

More specifically, (a), (b), (d) and (d) in FIG. 1 show the relationship between the movement of the empty bags W and bag holding members and the movement of the gripper pairs 1 in the empty bag supply process. In these Figures:

(a) The bag holding members (not shown) are at the reciprocating-motion starting position A, which is away from the movement path of the gripping sections 2 of the corresponding gripper pairs 1. At position A, empty bags W are positioned in a vertical state with the mouths thereof facing upward and centers thereof being at the position A, and the bag holding members are closed so that the upper edges of the empty bags W are gripped thereby. In this case, the gripper pairs 1 are located in positions that are somewhat behind the empty bags W. In other words, the center of each gripper pair 1 is behind the center position A of each empty bag W for the distance a.

(b) The bag holding members are accelerated; and from the acceleration end position B (to the deceleration starting position D), the speed of the empty bags W in the direction of movement of the gripper pairs 1 is equal to the moving speed of the gripper pairs 1. At the acceleration end position B, the gripper pairs 1 exactly overtake the empty bags W, so that the center of each gripper pair 1 comes into coincident with the center of each bag W; and during this period, the empty bags W are moved along the arc-shaped path S and approach the movement path of the gripping sections 2 of the gripper pairs 1 for the distance b.

(c) The empty bags W approach the movement path of the gripping sections 2 of the gripper pairs 1 even more closely along the arc-shaped path S and reach a region (bag transfer region C-D) where the bags and the gripping sections overlap.

(d) In the bag transfer region C-D, the gripping sections 2 of the gripper pairs 1 grip both side edges of the empty bags W; then, the bag holding members open so the empty bags W are released, thus causing the empty bags W to be transferred from the bag holding members to the gripper pairs 1. The bag holding members move beyond this bag transfer region, and then decelerate and stop at the reciprocating-motion end position E. The bag holding members then immediately initiate the return motion, and return to their original position (reciprocating-motion starting position A), where the bag holding members stop.

The above-described empty bag supplying apparatus will be described below more concretely with reference to FIGS. 2 through 8.

First, as shown in FIGS. 3 and 4A through 4D, four bag holding devices 3 are installed on the lower part of a supporting member 4. Each bag holding device 3 is comprised of; opening-and-closing supporting shafts 6 and 7, bag holding members 10 and 11, gears 12 and 13, an air cylinder 14, a connecting member 15, and a lever 20.

The opening-and-closing supporting shafts 6 and 7 are shaft-supported by bearings 5 attached to the undersurface of the supporting member 4. The bag holding members 10 and 11 are fastened, at the base ends thereof, to the respective opening-and-closing supporting shafts 6 and 7. The bag holding members 10 and 11 have holding surfaces (to which a rubber material 9 is pasted) on their broadly formed tip end portions 10*a* and 11*a*. The gears 12 and 13 are respectively attached to one end of each of the opening-and-closing supporting shafts 6 and 7, and the gears 12 and 13 are engaged with each other. The air cylinder 14 is attached to the upper portion of the supporting member 4. The connecting member 15 is attached to the tip end of the rod of the air cylinder 14. The lever 20 is fastened to one of the opening-and-closing supporting shafts 7 and is connected to the connecting member via pins 16 and 17 and a link 19.

Figure 4A:
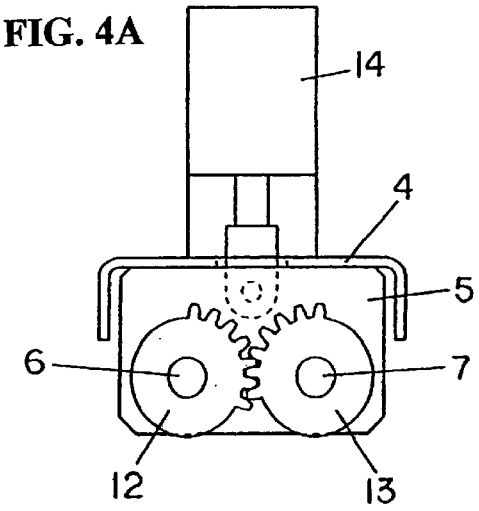
FIG. 4A is a sectional side view of the gear section of the bag holding device.
Figure 4B:
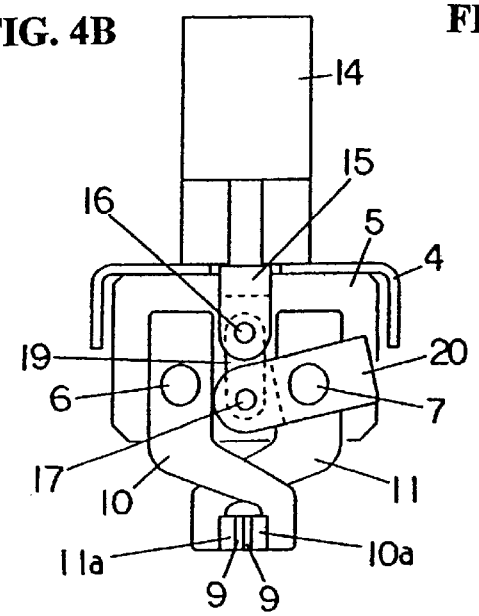
FIG. 4B is a sectional side view of the bag holding members (in a closed state) of the bag holding device.
Figure 4C:
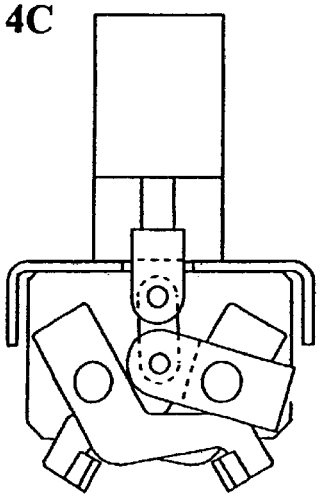
FIG. 4C is a sectional side view thereof (in an open state)
Figure 4D:
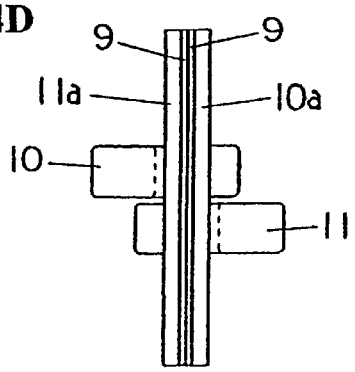
FIG. 4D is a bottom view of the bag holding members.

When the rod of the air cylinder 14 is retracted, the opening-and-closing supporting shaft 7 is rotated. At the same time, the opening-and-closing supporting shaft 6 is rotated in the opposite direction, so that the bag holding members 10 and 11 open (FIG. 4C) and close (FIG. 4B).

When the tip end portions 10*a* and 11*a* of the bag holding members are closed, the upper edges of the empty bag W are held by the holding surfaces of the bag holding members across more or less the entire width of the bag.

Figure 2:
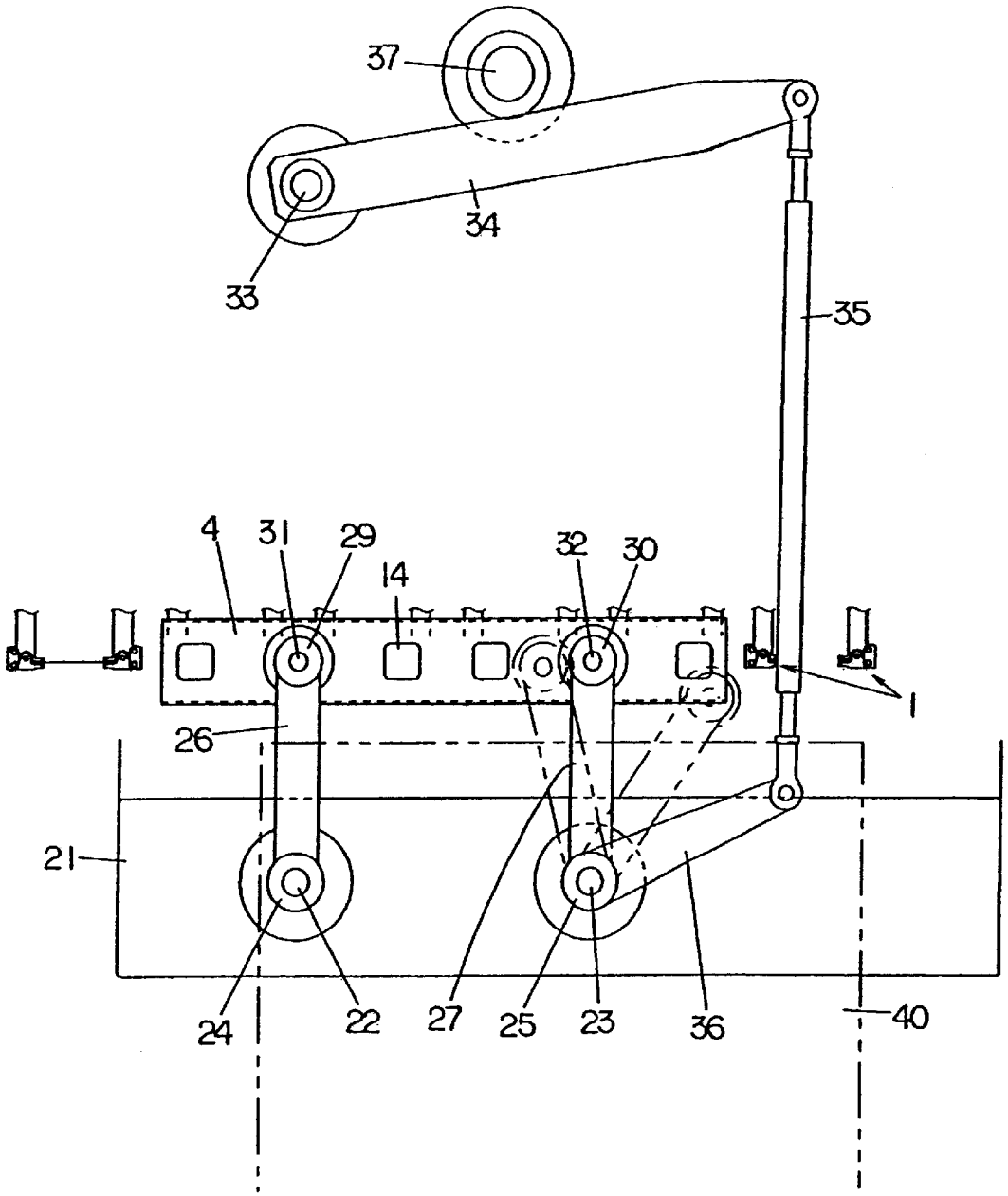
FIG. 2 is a top view of the empty bag supplying apparatus of the present invention.
Figure 3:
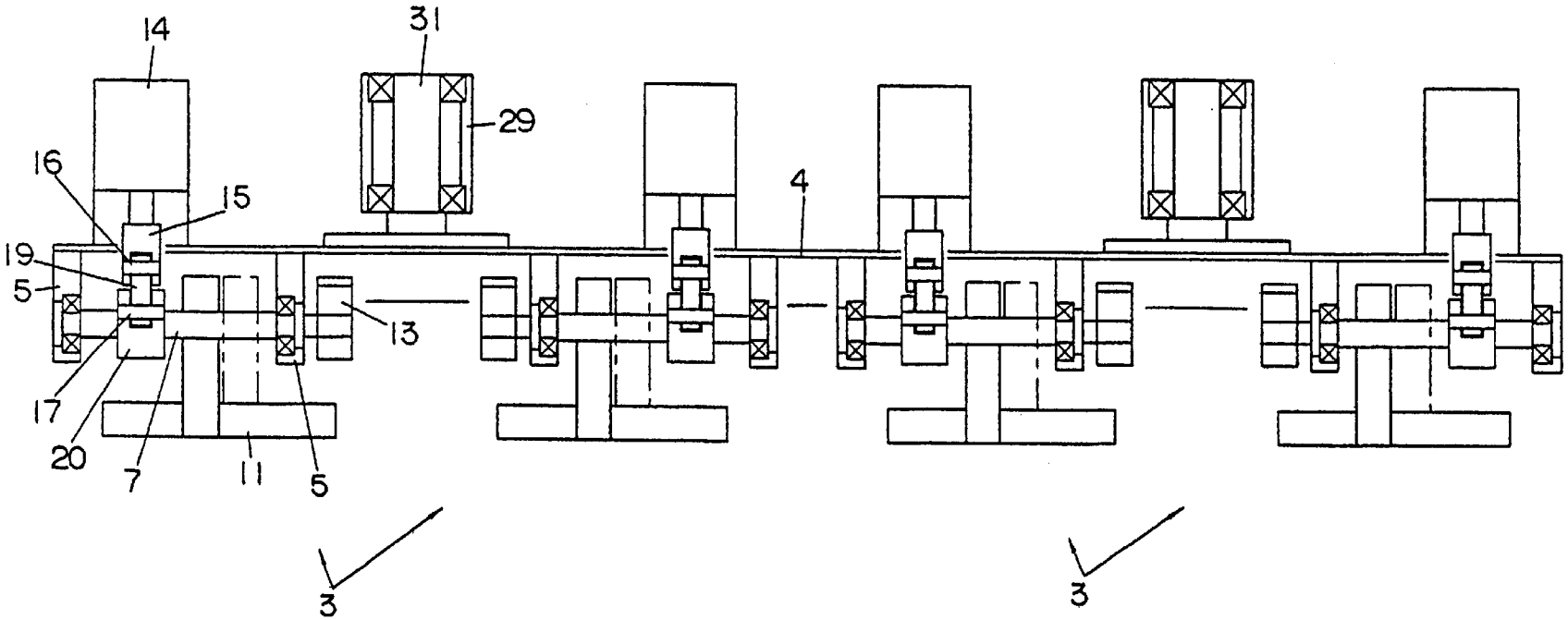
FIG. 3 is a sectional front view of a portion to which bag holding devices are provided.
Figure 5:
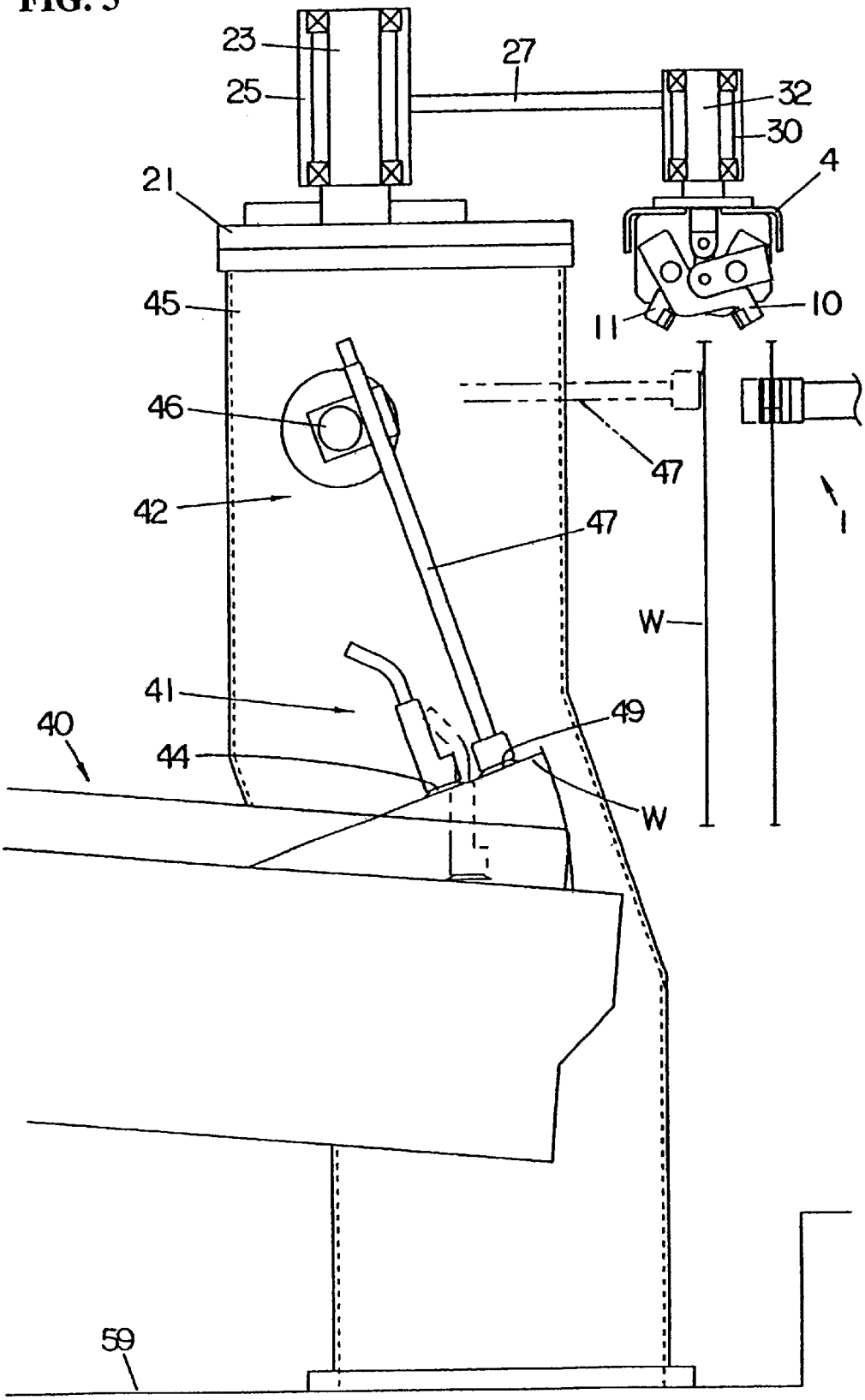
FIG. 5 is a side view (partially in section) of the bag supplying and positioning device.

The reciprocating movement mechanism of the bag holding members 10 and 11 (this mechanism causes the four bag holding devices 3 to perform a reciprocating motion as a whole) is, as shown in FIGS. 2, 3 and 5, comprised of: two supporting shafts 22 and 23, tubular pivot shafts 24 and 25, links 26 and 27, tubular swing shafts 29 and 30, and supporting shafts 31 and 32, etc.

The supporting shafts 22 and 23 are installed in an upright attitude on a supporting plate 21 in positions that are separated by a specified distance. The tubular pivot shafts 24 and 25 are rotatably fitted over the supporting shafts 22 and 23. The links 26 and 27 are fastened at one end to the pivot shafts 24 and 25. The tubular swing shafts 29 and 30 are fastened to the other ends of the links 26 and 27. The supporting shafts 31 and 32 are installed in an upright attitude on the supporting member 4, so that the swing shafts 29 and 30 rotatably fit on the supporting shafts 31 and 32.

The distance between the centers of the pivot shaft 24 and the swing shaft 29 and the distance between the centers of the pivot shaft 25 and the swing shaft 30 are set to be equal. The distance between the centers of the pivot shafts 24 and 25 and the distance between the centers of the swing shafts 29 and 30 are set to be equal. Thus, these shafts form a parallel link mechanism.

Furthermore, the above-described reciprocating movement mechanism further includes a swing lever 34 which is supported at its one end on a supporting shaft 33, a rod 35 which is connected to the other end of the swing lever 34, and a swing arm 36 with one end thereof being connected to the rod 35 and another end thereof being fastened to the pivot shaft 25.

As will be described later, the swing lever 34 performs a reciprocating swing motion through a specified angular range with the rotation of a drive shaft 37. This swinging motion is transmitted to the swing arm 36, so that the links 26 and 27 and supporting member 4 perform a reciprocating swing motion through a specified angular range (the swinging range of the link 27 is indicated by an imaginary line in FIG. 2).

On the principle of the above-described parallel link mechanism, the supporting member 4 performs a translational motion while performing the above-described reciprocating swing motion, so that the supporting member 4 always faces in the same direction (parallel to the movement path of the gripper pairs 1). Accordingly, the bag holding members 10 and 11 (four sets) also perform a reciprocating motion along the arc-shaped path S in a state in which the holding surfaces of the bag holding members are always oriented parallel to the movement path.

Figure 6:
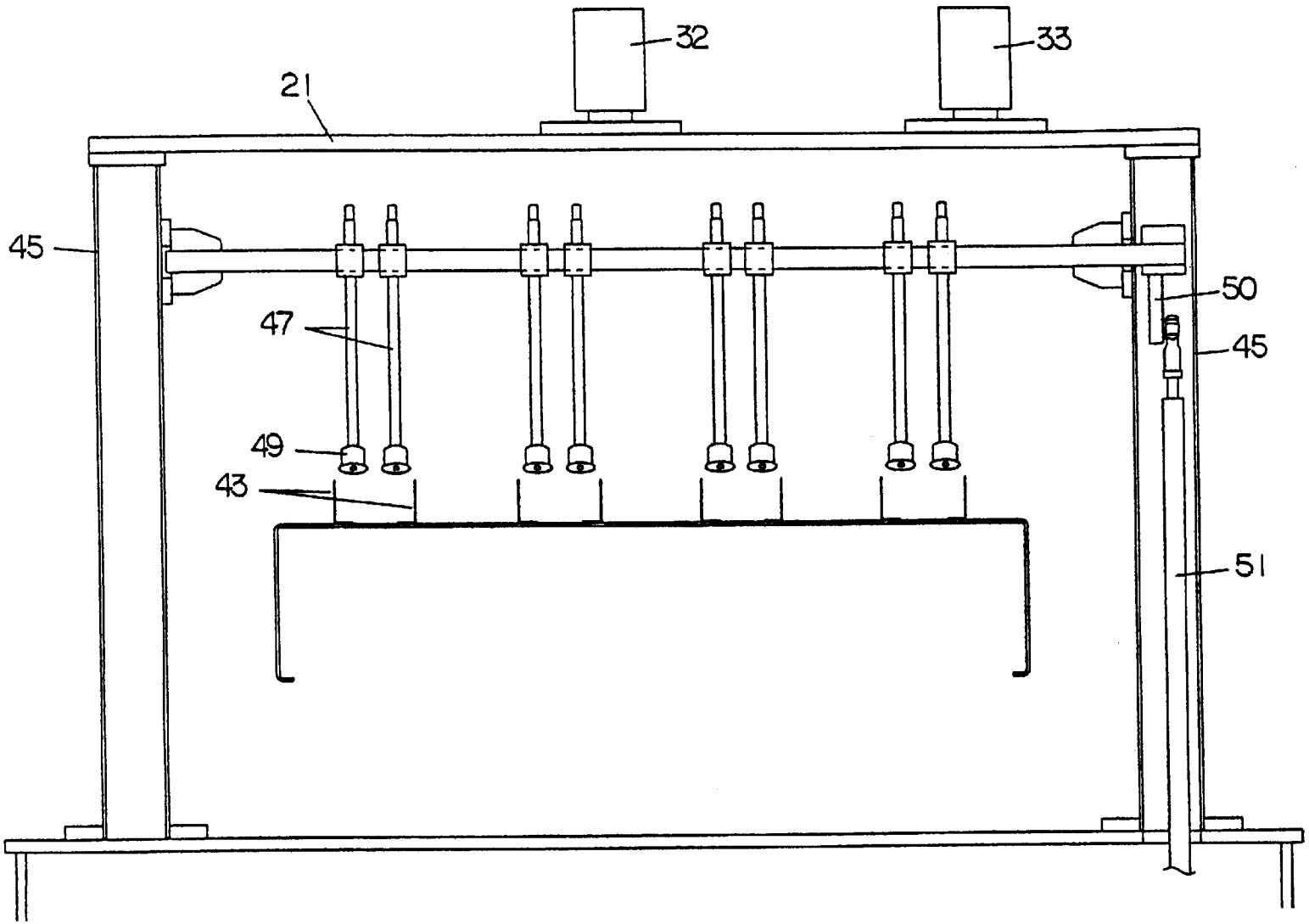
FIG. 6 is a front view of the positioning section of the bag supplying and positioning device.

As shown in FIGS. 5 and 6, a bag supplying and positioning device is disposed beneath the empty bag supplying apparatus. The bag supplying and positioning device positions empty bags W in the reciprocating motion starting position A on the arc-shaped path S of the bag holding members 10 and 11.

The bag supplying and positioning device is a conveyor magazine type bag supplying device that is known from, for example, Japanese Utility Model Application Laid-Open (Kokai) No. 61-59511, etc., and it is comprised of conveyor magazine sections 40, empty bag pickup sections 41 and an empty bag positioning section 42.

The conveyor magazine sections 40 (four sets) convey empty bags (which are stacked with the bags shifted in the longitudinal direction so that the upper portions of the empty bags are positioned in front) in the forward direction by means of belt conveyors. During this conveying action, the uppermost empty bag is separated and conveyed ahead over the belt conveyors so that the portions are caused to contact stoppers that are positioned in the vicinity of the tip ends of the belt conveyors. The reference numeral 43 in FIG. 6 is the guide plates that guide the side edges of the empty bags that are conveyed over the belt conveyors.

The empty bag pickup sections 41 (four sets) apply suction to the empty bags W contacting the stoppers by means of suction disks 44 that are attached to the tip ends of raising-and-lowering arms. Thus, the empty bag pickup sections 41 lift the empty bags W to a specified height (see the solid lines that show the lifted position and imaginary dashed lines in FIG. 5).

The empty bag positioning section 42 is comprised of: a swing supporting shaft 46, swing arms 47, suction disks 49 and a raising-and-lowering rod 51, etc.

The swing supporting shaft 46 is shaft-supported on the side of a supporting stand 45 that supports the supporting plate 21. The swing arms 47 (four pairs) are attached to this swing supporting shaft 46, and the suction disks 49 are attached to the tip ends of the swing arms 47.

The raising-and-lowering rod 51 is, at its upper end, attached to a swing lever 50 that is fastened to the swing supporting shaft 46. The lower end of the raising-and-lowering rod 51 is connected to a driving source (not shown) so as to be raised and lowered, thus causing the arms 47 to swing.

Suction is applied by the suction disks 49 to the empty bags W lifted by the suction disks 44, and the arms 47 are caused to swing upward (see the solid and imaginary dashed lines showing the raised position of the arms 47 in FIG. 5). As a result, the empty bags W are positioned in a vertical attitude with the bag mouths facing upward in the reciprocating motion starting positions A on the arc-shaped path S of the bag holding members 10 and 11 as described above.

Figure 7:
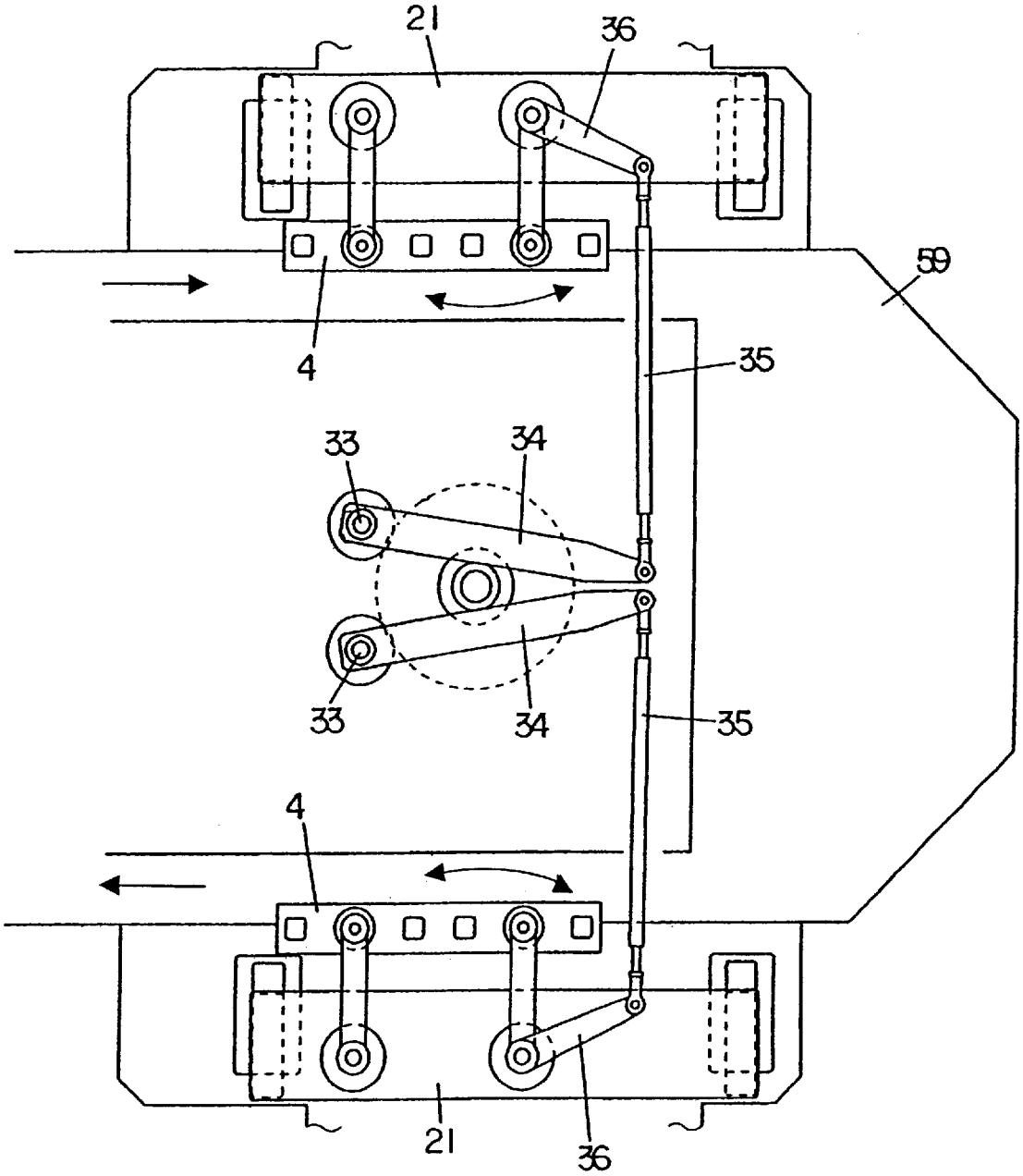
FIG. 7 is a top view of the empty bag supplying apparatus and product-filled bag extraction apparatus.
Figure 8:
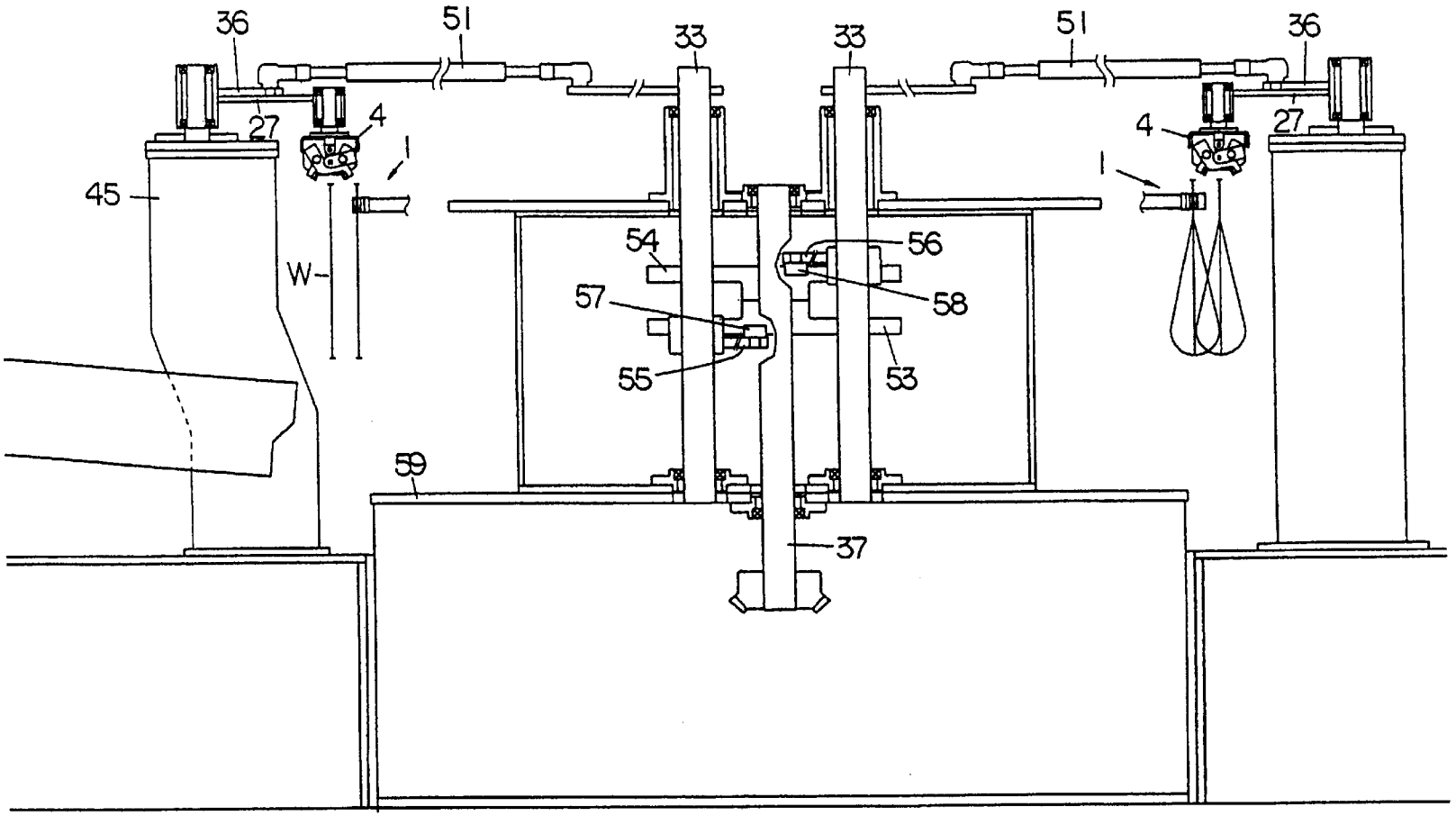
FIG. 8 is a sectional side view thereof.

FIGS. 7 and 8 show an empty bag supplying apparatus (on the lower side in FIG. 7 and the left side in FIG. 8) and a product-filled bag extraction apparatus (on the upper side in FIG. 7 and the right side in FIG. 8). The empty bag supplying apparatus and the product-filled bag extraction apparatus are disposed symmetrically in opposite positions in a continuous conveying type bag-filling packaging machine.

The product-filled bag extraction apparatus has substantially the same structure as the empty bag supplying apparatus (a structure that is symmetrical with the structure of the empty bag supplying apparatus). Accordingly, in FIGS. 7 and 8, the same numbers as those of the corresponding parts of the empty bag supplying apparatus are assigned to the respective parts of the product-filled bag extraction apparatus.

As seen from FIG. 8, groove cams 53 and 54 are attached to the drive shaft 37, and cam levers 55 and 56 are respectively fastened to the respective supporting shafts 33. Furthermore, cam rollers 57 and 58 are attached to the tip ends of the cam levers 55 and 56 so that these cam rollers are rotated horizontally, and the cam rollers 57 and 58 are inserted into the cam grooves of the groove cams 53 and 54.

When the drive shaft 37 is rotated continuously by a driving source (not shown), the cam rollers 57 and 58 run through the cam grooves so that the respective supporting shafts 33 perform a reciprocating rotating motion. As a result, the swing levers 34 perform a reciprocating swing motion through a specified angular range as described above about the supporting shafts 33, so that the supporting members 4 of the empty bag supplying apparatus and of the product-filled bag extraction apparatus are caused to perform a reciprocating motion as shown by arrows in FIG. 7.

The gripper pairs 1 are attached to an endless chain, etc. and moved continuously at a constant speed over the base 59 in the direction indicated by the arrow. As a result, empty bags W are supplied from the empty bag supplying apparatus in an empty bag supply process; then, after packaging treatments such as opening of the bag mouths, filling of the bags with contents and sealing of the bag mouths, etc., have been performed, the product-filled bags are extracted by the product-filled bag extraction apparatus in a product-filled bag extraction process.

In the product-filled bag extraction process, the reciprocating motion of the supporting member 4 and bag holding members 10 and 11 is performed more or less symmetrically with the reciprocating motion of the same elements in the empty bag supplying apparatus. Accordingly, the relationship between the movement of the product-filled bags and gripper pairs 1 and the movement of the bag holding members 10 and 11 in the product-filled bag extraction process is as follows (see FIG. 1):

(a) The bag holding members 10 and 11 initiate a reciprocating motion along the arc-shaped path from the reciprocating-motion starting position A near the movement path of the gripping sections 2 of the gripper pairs 1 (which is also the movement path of the product-filled bags), and the bag holding members 10 and 11 accelerate. At this time, the bag holding members 10 and 11 open (see FIG. 4C). Furthermore, the gripper pairs 1 (and product-filled bags) are in positions that are somewhat behind the bag holding members 10 and 11.

(b) From the acceleration end position B (to the deceleration starting position D), the speed of the bag holding members 10 and 11 in the direction of movement of the gripper pairs 1 is equal to the moving speed of the gripper pairs 1. At this acceleration end position B, the gripper pairs 1 (product-filled bags) exactly overtake the bag holding members 10 and 11. Furthermore, the arc-shaped path S of the bag holding members 10 and 11 approaches the movement path of the product-filled bags even more closely; and from this point on, a region in which both sets (the gripper pairs 1 and the bag holding members 10 and 11) substantially overlap for a brief distance (and such a region being referred to as a "bag receiving region") is formed.

(c) In this bag receiving region, the bag holding members 10 and 11 hold the upper edges of the product-filled bag. Then, the gripping sections 2 of the gripper pairs 1 are opened, thus releasing the product-filled bags. As a result, the product-filled bags are transferred from the gripper pairs 1 to the bag holding members 10 and 11.

(d) The bag holding members 10 and 11 are advanced further beyond this bag receiving region and moved away from the movement path of the gripping sections 2 of the gripper pairs 1. Then, the bag holding members decelerate and stop, and the bag holding members open and release the product-filled bags. The bag holding members then immediately initiate a return motion and return to their original positions (reciprocating-motion starting positions), where the bag holding members stop.

The released product-filled bags drop into specified positions on, for instance, a conveying means that is disposed below.

As seen from the above, according to the present invention, the structure of the empty bag supplying apparatus and product-filled bag extraction apparatus used in a continuous conveying type bag-filling packaging machine can be simplified. Accordingly, an empty bag supplying apparatus and product-filled bag extraction apparatus which is less costly and superior in terms of cleaning and maintenance characteristics can be provided. Furthermore, in the case of extraction, the product-filled bags can be securely and stably dropped into specified positions on a conveying means.

What is claimed is:

1. An empty bag supplying apparatus in a continuous conveying type bag-filling packaging machine wherein said empty bag supplying apparatus receives empty bags that are positioned in a vertical attitude with mouths of said bags facing upward and transfers said bags to respective gripper pairs of said continuous conveying type bag-filling packaging machine, said gripper pairs being moved continuously at a constant speed and at a uniform spacing and gripping both side edges of said bags by means of gripping sections thereof and conveying said bags in a vertically suspended fashion; and wherein:

said empty bag supplying apparatus is comprised of:

downward-facing bag holding members which open and close at a specified timing so as to hold upper portions of said bags when closed, a reciprocating movement mechanism which causes said bag holding members to perform a reciprocating motion along an arc-shaped path on a horizontal plane and which causes said bags held by said bag holding members to be set substantially parallel to a direction of movement of said gripper pairs at all times, and a bag transfer region that is established at an intermediate point on said arc-shaped path, said arc-shaped path substantially overlapping a movement path of said gripping sections of said gripper pairs within said bag transfer region, and a speed of said reciprocating motion of said bag holding members in a direction of movement of said gripper pairs being set to be substantially equal to a moving speed of said gripper pairs at least within said bag transfer region.

2. The empty bag supplying apparatus in a continuous conveying type bag-filling packaging machine according to claim 1, wherein a plurality of said bag holding members are provided on a common supporting member which performs a reciprocating motion along an arc-shaped path and which performs a translational motion during said reciprocating motion, and said bag holding members are disposed along a direction of movement at equal spacing as said gripper pairs.

3. The empty bag supplying apparatus in a continuous conveying type bag-filling packaging machine according to claim 2, wherein a mechanism that causes said supporting member to perform said reciprocating motion comprises:

two pivot shafts disposed with a specified distance in between, and respective swing shafts which are kept positioned at equal distances and in a same direction with respect to said respective pivot shafts, said swing shafts swinging about said respective pivot shafts as said pivot shafts are rotated; wherein said supporting member performs said translational motion as a result of being connected to said swing shafts.

4. A product-filled bag extraction apparatus in a continuous conveying type bag-filling packaging machine wherein said product-filled bag extraction apparatus receives product-filled bags, upon which packaging treatment has been completed, from respective gripper pairs of said bag-filling packaging machine and then discharges said product-filled bags to an outside of an movement path of said gripper pairs, said gripper pairs being moved continuously at a constant speed and at a uniform spacing and gripping both side edges of said bags by means of gripping sections thereof and conveying said bags in a vertically suspended fashion; and wherein:

said product-filled bag extraction apparatus is comprised of:

downward-facing bag holding members which open and close at a specified timing so as to hold upper portions of said bags when closed, a reciprocating movement mechanism which causes said bag holding members to perform a reciprocating motion along an arc-shaped path on a horizontal plane and which causes said bags held by said bag holding members to be set substantially parallel to a direction of movement of said gripper pairs at all times, and a bag receiving region that is established at an intermediate point on said arc-shaped path, said arc-shaped path substantially overlapping a movement path of said gripping sections of said gripper pairs within said bag receiving region, and a speed of said reciprocating motion of said bag holding members in a direction of movement of said gripper pairs being set to be substantially equal to a moving speed of said gripper pairs at least within said bag receiving region.

5. The product-filled bag extraction apparatus in a continuous conveying type bag-filling packaging machine according to claim 4, wherein a plurality of said bag holding members are provided on a common supporting member which performs a reciprocating motion along an arc-shaped path and which performs a translational motion during said reciprocating motion, and said bag holding members are disposed along a direction of movement at equal spacing as said gripper pairs.

6. The product-filled bag extraction apparatus in a continuous conveying type bag-filling packaging machine according to claim 5, wherein a mechanism that causes said supporting member to perform said reciprocating motion comprises:

two pivot shafts disposed with a specified distance in between, and respective swing shafts which are kept positioned at equal distances and in a same direction with respect to said respective pivot shafts, said swing shafts swinging about said respective pivot shafts as said pivot shafts are rotated; wherein said supporting member performs said translational motion as a result of being connected to said swing shafts.

* * * * *